United States Patent [19]

Brown

[11] 4,289,042

[45] Sep. 15, 1981

[54] VIBRATOR WITH ECCENTRIC WEIGHTS

[75] Inventor: William R. Brown, Blairsville, Pa.

[73] Assignee: FMC Corporation, San Jose, Calif.

[21] Appl. No.: 21,388

[22] Filed: Mar. 19, 1979

Related U.S. Application Data

[62] Division of Ser. No. 899,042, Apr. 24, 1978, Pat. No. 4,211,121, which is a division of Ser. No. 719,634, Sep. 1, 1976, abandoned.

[51] Int. Cl.[3] ..... F16H 33/00; F16H 1/30

[52] U.S. Cl. ..... 74/61; 74/665 GB; 74/665 K; 74/777; 74/799

[58] Field of Search ..... 74/828, 831, 840, 665 GB, 74/665 K, 665 M, 713, 757, 777, 799, 61, 87; 198/770

[56] References Cited

U.S. PATENT DOCUMENTS

| | | | |
|---|---|---|---|
| 1,262,817 | 4/1918 | McCreary | 74/395 |
| 2,078,715 | 4/1937 | Lurz et al. | 74/61 |
| 2,573,764 | 11/1951 | Green | 74/713 |

FOREIGN PATENT DOCUMENTS

| | | | |
|---|---|---|---|
| 629000 | 4/1936 | Fed. Rep. of Germany | 74/87 |
| 1841635 | 11/1961 | Fed. Rep. of Germany | 74/87 |
| 1245188 | 4/1963 | Fed. Rep. of Germany | 74/87 |
| 1275316 | 8/1968 | Fed. Rep. of Germany | 74/87 |
| 765723 | 6/1934 | France | 61/ |
| 448889 | 6/1936 | United Kingdom . | |
| 658718 | 10/1951 | United Kingdom | 74/87 |
| 922071 | 3/1963 | United Kingdom . | |
| 1050991 | 12/1966 | United Kingdom . | |
| 1120143 | 7/1968 | United Kingdom . | |
| 1349570 | 4/1974 | United Kingdom . | |
| 1363205 | 8/1974 | United Kingdom . | |
| 1369650 | 10/1974 | United Kingdom . | |

*Primary Examiner*—Lawrence J. Staab
*Attorney, Agent, or Firm*—Jack W. Edwards; Richard B. Megley

[57] ABSTRACT

Two eccentric weights of a vibrator are mounted, respectively, on two coaxial shafts, one of which is a hollow shaft mounted on the other shaft. The two shafts can be connected for rotation in unison, and can be separated for relative rotation to alter the angular relationship between the weights. Mechanism is provided to alter the angular relationship between the weights while both shafts continue to rotate. The hollow shaft and the other shaft are connected, respectively, to one end of two beveled gear trains which can rotate as a unit about the axis of the shafts. By changing the angular relationship between the gears at the other end of the gear trains, the angular relationship between the eccentric weights, and hence the stroke of the vibrator, can be changed.

7 Claims, 5 Drawing Figures

VIBRATOR WITH ECCENTRIC WEIGHTS

This is a division of application Ser. No. 899,042, filed Apr. 24, 1978, now U.S. Pat. No. 4,211,121, which is a division of Ser. No. 719,634, filed Sept. 1, 1976, now abandoned.

BACKGROUND OF THE INVENTION

1. Field of the Invention

The present invention relates to vibrators, and, more particularly, to vibrators utilizing eccentric weights to produce the desired vibrations.

2. Description of the Prior Art

Vibrators are used to induce vibrations in various types of industrial equipment for diverse purposes such as feeding material, screening material, or dislodging material. In some applications, such as in a two mass vibrating system used to feed material at a predetermined rate, the magnitude of the stroke of the vibrator is important.

One method of producing vibrations in a vibrator is by use of a rotating shaft with an eccentric weight, or weights thereon. Frequently, as shown, for example, in the U.S. Pat. Nos. 2,934,202; 3,396,294; 3,920,222; and 3,922,042, two or more eccentric weights are used which can be set at different angular positions on the driven shaft relative to each other to change the total effective eccentricity of the weights, and therefore to change the stroke of the vibrator. In the usual eccentric weight vibrator, it is difficult to change the relative angularity of the weights, and the vibrator must be stopped to accomplish the modification.

In at least one earlier rotary vibrator (U.S. Pat. No. 3,920,222), apparatus has been provided for the purpose of changing the angle between the eccentric weights while the vibrator is running.

SUMMARY OF THE INVENTION

In the present invention, a vibrator is provided with an improved mounting for the eccentric weights which facilitates the angular adjustment of two weights relative to each other. The mounting of the eccentric weights in accordance with the present invention lends itself to adjustment of the eccentric weights while the vibrator is running, and a system for accomplishing this desirable goal in an effective, positive manner is disclosed.

In brief, in accordance with the present invention, a vibrator having a first eccentric element mounted for rotation about a longitudinal axis and having a second eccentric element mounted for rotation about said longitudinal axis, said vibrator having means including a motor to rotate said eccentric elements in unison, has an improvement wherein said rotating means includes a first bevel gear on said longitudinal axis connected to said first eccentric element, a second bevel gear on said longitudinal axis connected to said second eccentric element, means, including a frame rotatable about said axis and bevel gearing rotatably mounted on said frame on an axis transverse to said longitudinal axis, to connect said first and second bevel gears for rotation of said first and second bevel gear and said first and second eccentric elements in unison, and means to rotate one of said first and second bevel gears relative to the other of said first and second bevel gears to change the angular relationship between said first and second eccentric elements.

It is therefore one object of the present invention to facilitate the shifting of eccentric weights in an eccentric weight vibrator.

It is still another object of the present invention to provide mounting mechanism for the eccentric weights of a vibrator which facilitates the relative angular adjusting of the weights from a position remote from the weights.

It is another object of the present invention to provide a mounting for eccentric weights in a vibrator which permits the relative angular positioning thereof during operation of the vibrator.

It is yet another object of the present invention to provide power operated mechanism to change the relative angular position between weights while the vibrator is running.

DESCRIPTION OF THE PREFERRED EMBODIMENT

Figure 1:
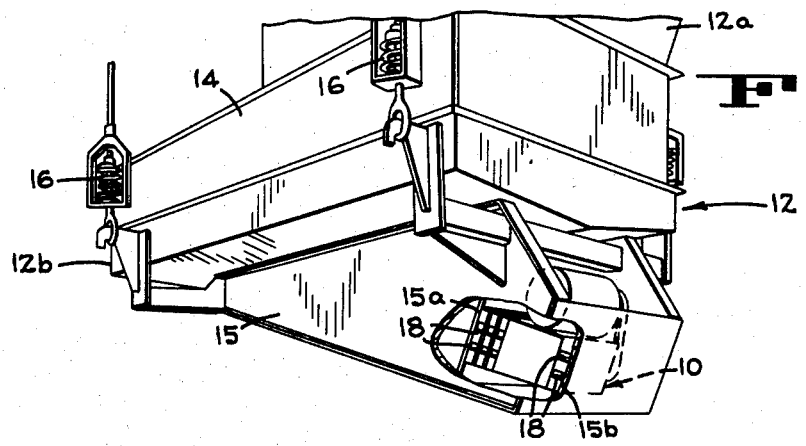
FIG. 1 is a view in perspective of an electromechanical vibrating feeder incorporating the vibrator of the present invention.

There is shown in FIG. 1 a vibrator 10 constructed in accordance with the present invention. The vibrator 10 is shown, for illustrative purposes, as the driving force of a vibratory feeder 12 which is designed to receive material at an input end 12*a* and discharge material at a discharge end 12*b*. The vibrator of the present invention can be used to drive other machines, such as vibratory screens or, in fact, any equipment which it is desired to vibrate.

It will be understood by those skilled in the art that the feeder 12 includes a trough 14 which is suspended by springs 16 from an overhead support. The feeder has a drive housing 15 which is rigidly connected to trough 14, and the housing 15 has spaced walls 15*a*, 15*b*. The vibrator 10 is mounted by means of springs 18 between the walls 15*a*, 15*b* to form with the trough a two mass, spring coupled, electromechanical vibratory feeder.

Figure 2:
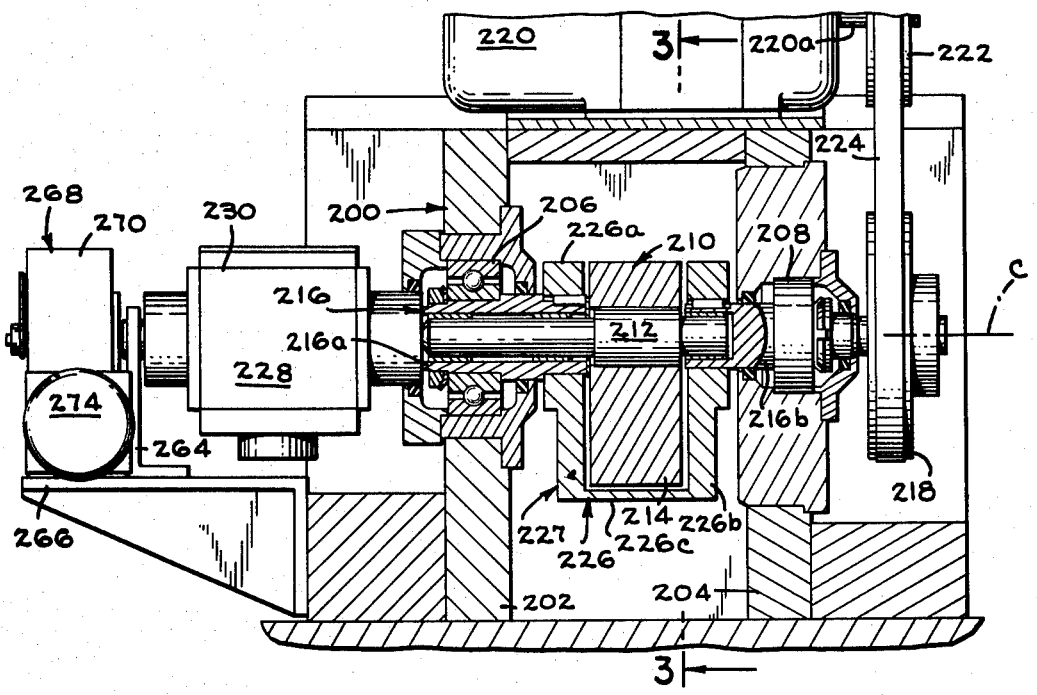
FIG. 2 is a side view, partially in section, showing the vibrator of the present invention.
Figure 3:
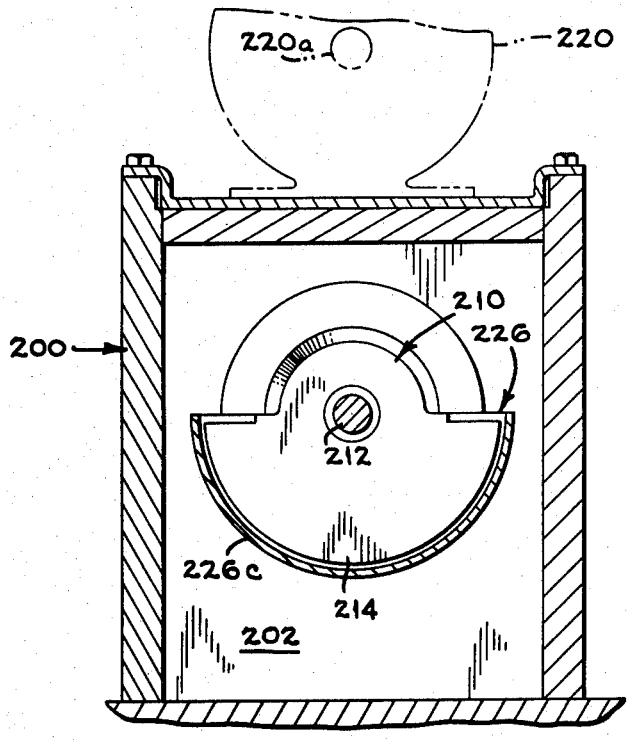
FIG. 3 is a view taken on the lines 3—3 of FIG. 2.

As shown in FIGS. 2 and 3, a vibrator housing 200 has side walls 202, 204 with openings therein lying on an axis C. Bearings 206, 208 are mounted in the openings in the walls 202, 204, respectively.

A first eccentric element 210 comprises a shaft 212 and a weight 214 secured to shaft 212. The weight 214 has a center of gravity spaced from the longitudinal rotational axis of the shaft, axis C, and constitutes an eccentric weight which renders the element 210 made up of weight 214 and shaft 212 eccentric.

A hollow shaft 216 has two portions: a first portion 216*a* mounted over shaft 212 and rotatably supported on axis C by bearing 206, and a second portion 216*b* mounted over the end of shaft 212 and rotatably supported on axis C by bearing 208. The outer end of shaft portion 216*b* extends outside the housing 200 and receives thereon a pulley 218. An electric motor 220 is mounted on the housing, and a pulley 222 is mounted on the motor drive shaft 220*a*. A belt 224 is received over pulleys 218, 222 for rotation of shaft portion 216*b* on axis C by the motor.

An eccentric weight 226 is mounted on hollow shaft 216. The weight 226 has a first portion 226*a* which is keyed to first hollow shaft portion 216*a*, and has a second portion 226*b* which is keyed to second shaft portion 216*b*. The weight 226 also has an intermediate arcuate portion 226*c* which connects the weight portions 226*a* and 226*b*. Thus, when hollow shaft portion 216*b* is driven by motor 220, the torque is transmitted through weight 226 to drive hollow shaft portion 216*a*. The weight 226, like weight 214, has a center of gravity spaced from the axis C of rotation of hollow shaft 216 to constitute an eccentric weight. Thus, the hollow shaft 216 and weight 226, which is keyed to the hollow shaft, constitutes a second eccentric element 227. Both shaft 212 and hollow shaft 216 terminate at a gearbox 228.

Figure 4:
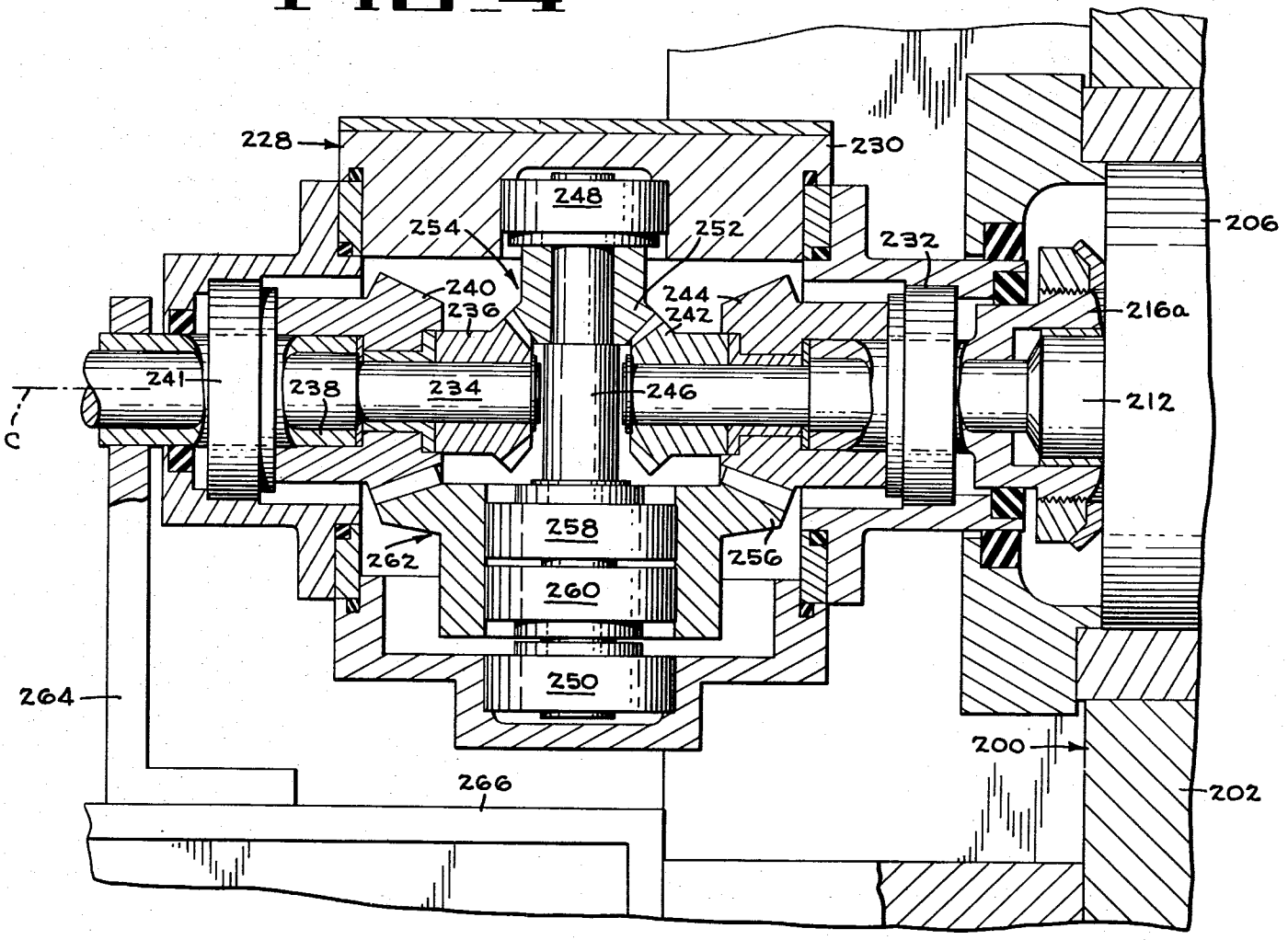
FIGS. 4 and 5 are enlarged views, taken as the view of FIG. 2, of portions of the vibrator of FIG. 2.

The gearbox 228, as shown in FIG. 4, has a housing or frame 230 which is rotatably supported, at one end, on a bearing 232 received on the end of hollow shaft portion 216*a*. A first control member 234 consists of a shaft having a first control bevel gear 236 secured to its inner end. A second control member 238, which is in the form of a hollow shaft, has a second control bevel gear 240 secured to its inner end. Shaft 234 is rotatably received in hollow shaft 238, which is journaled in bearing 241. A first drive bevel gear 242 is secured to the outer end of shaft 212, and a second drive bevel gear 244 is secured to the outer end of hollow shaft portion 216*a*.

An intermediate shaft 246 is mounted transversely in the gearbox frame and is journaled in bearings 248, 250 therein. A first intermediate bevel gear 252 is secured on shaft 246 and forms, with bevel gears 236, 242, a gear train 254 between shaft 212 (and hence the first eccentric element 210 of which shaft 212 is a part) and the first control member, or shaft, 234. A second intermediate bevel gear 256 is rotatably mounted on bearings 258, 260 (which are received on intermediate shaft 246) for rotation relative to shaft 246. The second intermediate bevel gear forms a gear train 262 with bevel gears 240, 244, between hollow shaft portion 216*a* (and hence the second eccentric element 227) and the second control member, or hollow shaft 238.

Hollow shaft 238 is supported, outside the gearbox 228, by a standard 264 which is connected by bracket 266 to vibrator housing 200.

Figure 5:
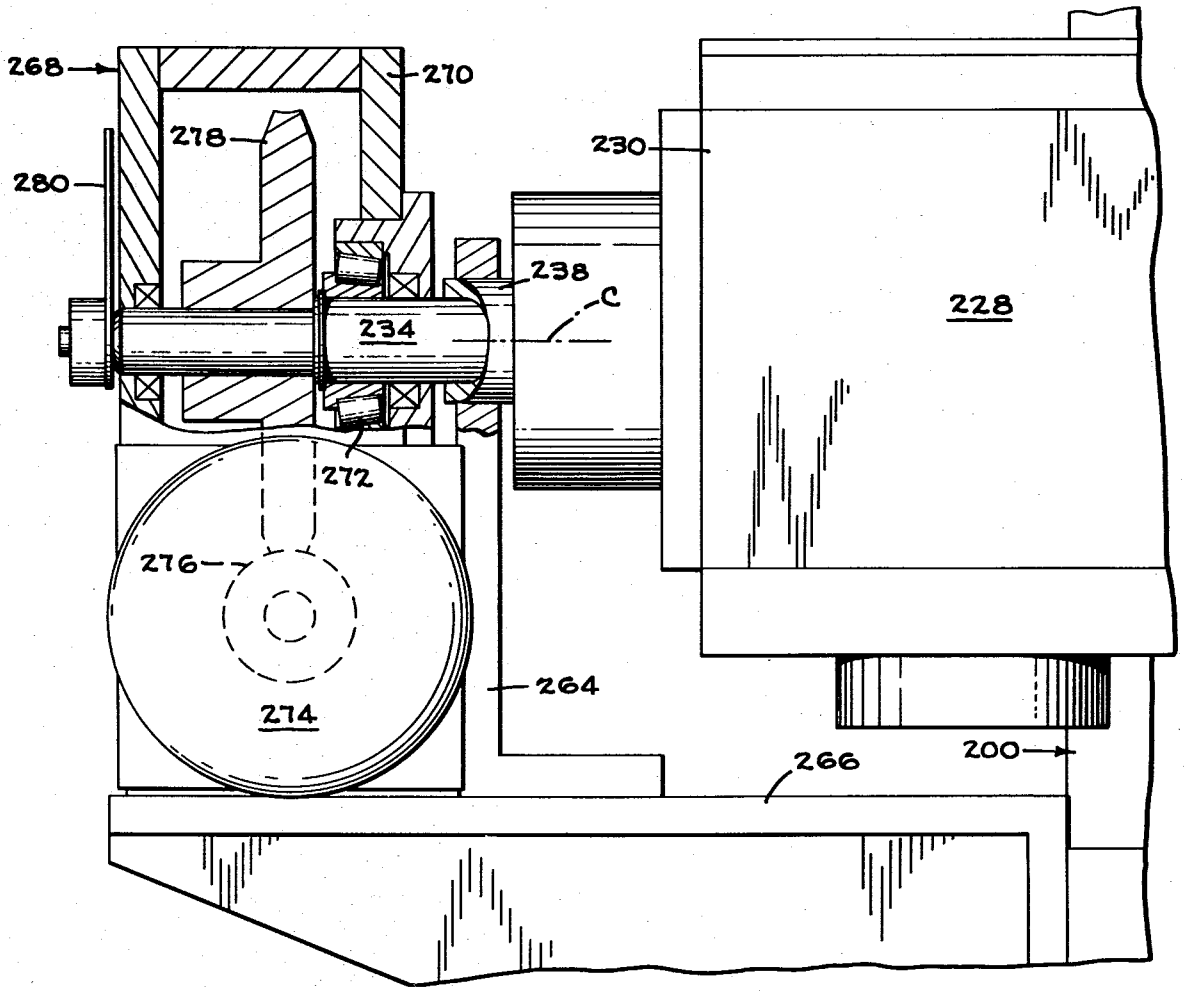

Apparatus, indicated generally at 268 as shown in FIG. 5, is provided outside the gear box 228 to effect relative rotation between the first control member (shaft 234) and the second control member (hollow shaft 238). The apparatus includes a housing 270 mounted on bracket 266, and bearing 272 mounted in the housing to receive the shaft 234. The hollow shaft 238 terminates at standard 264 (short of housing 270) and is secured to the standard so that gear 240 (which is secured to shaft 238) is always stationary. A motor 274 (when energized) drives a worm 276 which rotates a worm wheel 278 secured to shaft 234. A pointer 280 is mounted on the end of shaft 234 outside the housing 270.

During normal operation of the vibrator, the hollow shaft 216 is rotated by motor 220. At this time, the first control shaft 234 is held stationary by the worm 276 which engages the worm wheel 278 preventing it from rotating when the motor 274 is deenergized, and the second control shaft 238 is secured to the standard 264 and is always stationary. Thus, the bevel gear 244 on shaft 216 rotates gear 256 which, since gear 240 does not rotate, effects a rotation of the gearbox frame 230 about axis C. The rotation of the gear box frame 230 with respect to the stationary gear 236 causes gear 252 to rotate, rotating gear 242. Thus, the shaft 212 rotates in unison with hollow shaft 216. The eccentric weights 214 and 226 on shaft 212 and hollow shaft 216, respectively, are rotating with the shaft and hollow shaft, and are positioned relative to each other as shown in FIGS. 2 and 3 to produce the maximum eccentricity and the maximum stroke of the vibrator.

If it is desired to reduce the stroke of the vibrator (which can be done while the vibrator continues to run), the motor 274 is momentarily energized to rotate worm 276 and worm wheel 278, to rotate control shaft 234. Since bevel gear 240 remains stationary, the rotation of control shaft 234, and bevel gear 236 thereon, changes the relative angular position of bevel gears 242 and 244 (which continue to rotate) and hence the relative angular positions of the first and second eccentric members. The pointer 280 indicates the amount of rotation of shaft 234, and hence the extent of eccentricity in the vibrator.

Although the best mode contemplated for carrying out the present invention has been herein shown and described, it will be apparent that modification and variation may be made without departing from what is regarded to be the subject matter of the invention.

What is claimed is:

1. A vibrator comprising a gearbox, a first rotatable shaft member terminating at said gearbox, a first eccentric weight connected to said first shaft member, a rotatable hollow shaft member mounted on the first shaft member and terminating at the gearbox, a second eccentric weight connected to said hollow shaft member, means to drive one of said rotatable members, a first control shaft and a second control shaft coaxially mounted in said gearbox on an axis common to the rotatable shaft members, a first bevel gear train in said gearbox connecting said first control shaft to said first rotatable shaft member and a second bevel gear train in said gearbox connecting said second control shaft to said rotatable hollow shaft member.

2. A vibrator comprising a gear frame rotatable about an axis, said frame having a first control shaft mounted in said frame on said axis, said control shaft having a first bevel gear mounted thereon, a first eccentric element terminating at said gear frame on said axis and having a bevel gear mounted thereon, a second control shaft mounted in said frame on said axis, a second eccentric element terminating at said gear frame on said axis and having a bevel gear mounted thereon, a first intermediate bevel gear mounted in said gear frame and forming a gear train with said first bevel gear and the gear on one of said eccentric elements, and a second intermediate bevel gear mounted in said gear frame and forming a gear train with said second bevel gear and the gear on the other of said eccentric elements.

3. In a vibrator having a first weighted eccentric element on a longitudinal axis and having a second weighted eccentric element on said longitudinal axis, said vibrator including a housing supporting said weighted eccentric elements and a motor connected to said first eccentric element to rotate said first eccentric element about said axis, the improvement comprising a frame, means to mount said frame for rotation about said longitudinal axis, said frame having a pair of relatively rotatable bevel gears mounted thereon on an axis transverse to said longitudinal axis, a first bevel gear train including one of the gears mounted on the frame, a gear connected to said first eccentric element, and a gear fixed relative to said housing, a second bevel gear train including the other gear mounted on the frame, a control gear and a gear connected to said second eccentric element to drive said second element in unison with said first eccentric element, said control gear rotatable to rotate the gears of said second bevel gear train relative to said first bevel gear train to change the angular relationship between said eccentric elements.

4. In a vibrator having concentric shafts on a longitudinal axis including an inner shaft and an outer shaft, each of said shafts having an eccentric weight secured thereon, said vibrator having a motor to rotate one of said shafts, the improvement comprising a frame, means to mount said frame for rotation about said longitudinal axis, a pair of bevel gears mounted in said frame for relative rotation on an axis transverse to said longitudinal axis, a first pair of concentric bevel gears mounted on said longitudinal axis on one side of said transverse axis, the inner and outer concentric bevel gears of said first pair of bevel gears connected respectively to the inner and outer concentric shafts, a second pair of concentric bevel gears mounted on said longitudinal axis on the other side of said transverse axis, means to hold the outer bevel gear of said second pair of concentric gears stationary, and said inner bevel gear of said second pair of concentric gears rotatable relative to the outer bevel gear of said second pair, the outer bevel gears of said first and second pairs of bevel gears and one of said bevel gears on said transverse axis forming a first bevel gear train and the inner bevel gears of said first and second pairs of bevel gears and the other of said bevel gears on said transverse axis forming a second bevel gear train, and means to rotate the inner bevel gear of said second pair of bevel gears to rotate the gears of said second bevel gear train relative to the gears of said first bevel gear train to change the angular relationship between said inner shaft and said outer shaft and thereby change the angular relationship of the weights on the shafts.

5. In a vibrator having a first pair of concentric shafts on an axis of rotation, each of said shafts having eccentric weights connected thereto to define with said shafts eccentric elements, the improvement comprising a second pair of concentric shafts on said axis, a first differential bevel gear train between one shaft in said first pair of shafts and one shaft in said second pair of shafts, and a second differential bevel gear train between the other shaft in said first pair of shafts and the other shaft in said other pair of shafts, means to effect relative rotation between the shafts on said second pair of shafts to change the phase relation between said eccentric weights.

6. The vibrator of claim 5 wherein said relative rotation effecting means includes means to hold one of said shafts of said second pair of shafts stationary and means including a motor to rotate the other of said shafts.

7. The vibrator of claim 6 wherein said other shaft rotating means includes a worm driven by said motor and a worm wheel secured to said other shaft.

* * * * *